US005676210A

United States Patent [19]

Sundholm

[11] Patent Number: 5,676,210

[45] Date of Patent: Oct. 14, 1997

[54] METHOD AND INSTALLATION FOR FIGHTING FIRE

[76] Inventor: Göran Sundholm, Ilmari Kiannon kuja 3, FIN-04310 Tuusula, Finland

[21] Appl. No.: 416,873

[22] PCT Filed: Oct. 19, 1993

[86] PCT No.: PCT/FI93/00429

§ 371 Date: Apr. 19, 1995

§ 102(e) Date: Apr. 19, 1995

[87] PCT Pub. No.: WO94/08659

PCT Pub. Date: Apr. 28, 1994

[30] Foreign Application Priority Data

| | | | |
|---|---|---|---|
| Oct. 20, 1992 | [FI] | Finland | 924752 |
| Mar. 29, 1993 | [FI] | Finland | 931405 |

[51] Int. Cl.[6] ..... A62C 35/02

[52] U.S. Cl. ..... 169/9; 169/71

[58] Field of Search ..... 169/9, 71, 72, 169/85

[56] References Cited

U.S. PATENT DOCUMENTS

| | | | |
|---|---|---|---|
| 4,069,873 | 1/1978 | McClure | 169/9 |

FOREIGN PATENT DOCUMENTS

| | | | |
|---|---|---|---|
| 0107837 | 5/1984 | European Pat. Off. . | |
| 148858 | 6/1981 | Germany . | |
| 296209 A | 11/1991 | Germany | 169/9 |
| 1225585 | 1/1981 | U.S.S.R. . | |
| 935112 | 6/1982 | U.S.S.R. | 169/9 |
| 1442225 | 12/1988 | U.S.S.R. | 169/9 |
| 1674865 | 3/1989 | U.S.S.R. . | |
| 1563712 | 5/1990 | U.S.S.R. . | |
| 1570736 | 6/1990 | U.S.S.R. | 169/85 |
| 1667877 A | 8/1991 | U.S.S.R. | 169/9 |
| 446626 | 5/1936 | United Kingdom | 169/71 |
| 9100122 | 1/1991 | WIPO . | |
| 9107208 | 5/1991 | WIPO . | |
| 9222353 | 12/1992 | WIPO . | |

*Primary Examiner*—Gary C. Hoge
*Attorney, Agent, or Firm*—Ladas & Parry

[57] ABSTRACT

The object of the invention is to provide a new method and a new installation for fighting fire, including difficult smouldering fires, such as cable fires e.g. in the upper region of a room where the walls meet the ceiling. The fire is initially, in a first step, fought by means of at least one fog-like liquid spray having comparatively large droplets and a good penetration power, in order to at least suppress the fire, and thereafter, in a second step, the initially utilized fog-like liquid spray is scattered, by mixing a pressurized non-combustible gas into the liquid, to form a turbulent liquid fog for filling the fire room at least essentially evenly and for extinguishing smouldering fire seats.

4 Claims, 4 Drawing Sheets

METHOD AND INSTALLATION FOR FIGHTING FIRE

The present invention relates to a method and an installation for fighting fire.

A problem with fighting a fire in a room by means of a preferably automatically releasable installation for fighting fire is that the main fire seat, and secondary fire seats and smaller fires in general as well, may not be totally extinguished but can remain smouldering.

Difficult smouldering fires are in particular fires in the upper region of a room where the walls meet the ceiling, e.g. cable fires.

The object of the invention is to provide a new method and a new installation for fighting fire, including difficult smouldering fires.

The method according to the invention is mainly characterized in that the fire is initially, in a first step, fought by means of at least one fog-like liquid spray having comparatively large droplets and a good penetration power, in order to at least suppress the fire, and thereafter, in a second step, the initially utilized fog-like liquid spray is scattered, by mixing a pressurized non-combustible gas into the liquid, to form a turbulent liquid fog for filling the fire room at least essentially evenly and for extinguishing smouldering fire seats.

By a fog-like spray is meant a spray of small droplets having a diameter typically 30 to 150 microns and preferably set in a strong whirling motion. As earlier mentioned, by a high charge pressure is here in general meant from about 30 bar up to about 300 bar, as compared to an operating pressure of generally 2 to 10 bar in conventional sprinkler installations which produce a rain-like spray. It shall be noted, however, that the values given above are not absolute; definite limiting values are difficult to present.

Large fires are extinguished or are at least suppressed to a great extent by the effect of steam generation; the steam prevents oxygen from entering into the fire and the generation of steam binds large amounts of heat. For smaller fires and smouldering fires it is essential that the air sucked into the fire seat shall have a liquid content sufficient for cooling.

Preferably the initially utilized fog-like liquid spray is scattered by intermixing therein such a gas which is lighter than air, preferably nitrogen, so that the intermixed gas, preferably drive gas from at least one hydraulic high pressure accumulator, rises and brings liquid droplets to the ceiling of the room, in order to ensure that fire seats in the upper regions of a room are extinguished by the combined effect of the gas itself and of the liquid droplets following with the gas.

When nitrogen gas accumulates up under the ceiling, together with small droplets which due to the turbulence remain airborne for a comparatively long time, e.g. smouldering cable fires and the like at the ceiling level are effectively smothered.

By successively, or step-wise, increasing the amount of intermixed gas in relation to the liquid, accordingly smaller droplets are obtained, with a prolonged airborne time in spite of a gradually decreasing turbulence.

If there is reason to assume that a somewhat greater concentration in the lower region of the room would be of advantage in the final stage of the extinguishing process, e.g. argon gas can be used as intermixing gas.

A preferred embodiment of the installation according to the invention comprises at least one spray head capable of producing a fog-like liquid spray at a high operating pressure and having a good penetration power, a drive unit with at least one hydraulic accumulator chargeable to a high initial drive pressure, the liquid being arranged to be driven out through a tube which starts at the bottom portion of the liquid space of the accumulator and extends through the gas space of the accumulator to the outlet thereof, and said tube having at least one aperture in its wall, at a predetermined distance from the outlet end of the tube and with a predetermined diameter, so that drive gas flows into the tube through said at least one aperture in the wall, when the liquid level in the hydraulic accumulator has reached said aperture, in order to thereby scatter the initially produced fog-like liquid spray into a turbulent liquid fog.

Preferably said tube has a plurality of apertures in its wall, at different levels, so that as the gas pressure of the hydraulic accumulator decreases, the amount of drive gas mixed into the extinguishing liquid increases.

For relatively small spaces it may be sufficient to have a drive unit comprising one single hydraulic accumulator. In installations requiring a larger capacity it is preferable to use a plurality of hydraulic accumulators coupled in parallel and with a common high pressure gas source, e.g. a pressure bottle filled with nitrogen gas.

The invention shall in the following be described in more detail, with reference to exemplifying preferred embodiments shown in the attached drawing.

FIGS. 1, 2 and 3 illustrate the different stages of a fire extinguishing procedure in a room.

FIGS. 4, 5 an 6 illustrate the corresponding situations in a hydraulic accumulator utilized as a drive unit.

Figure 1:
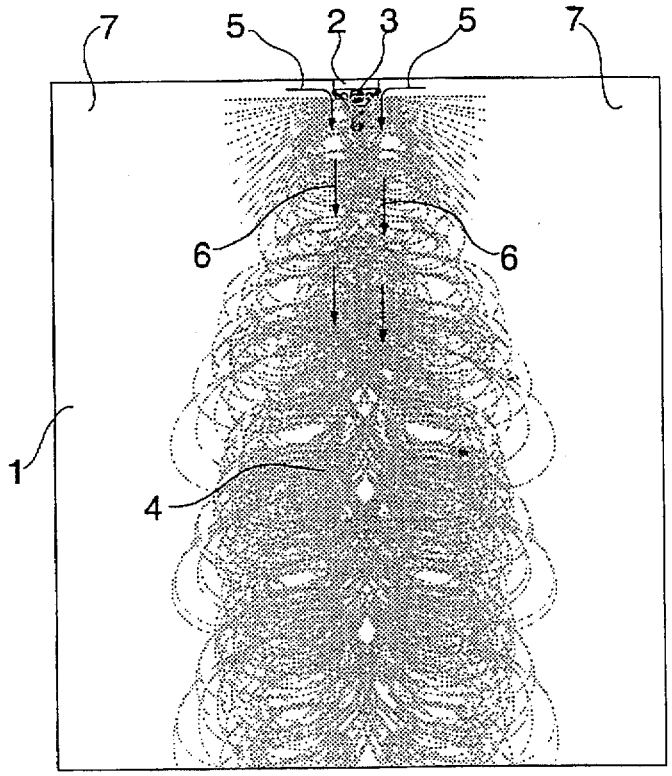
Figure 2:
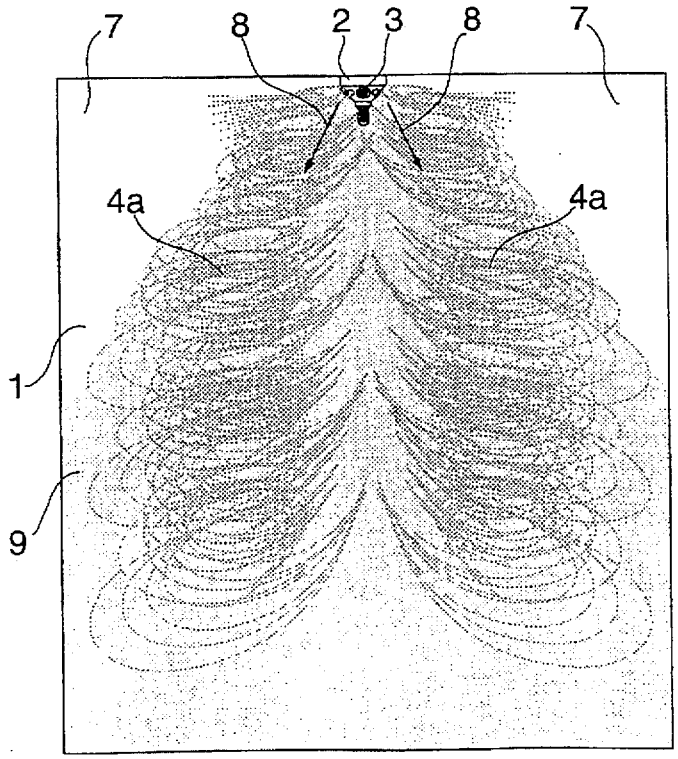
Figure 3:
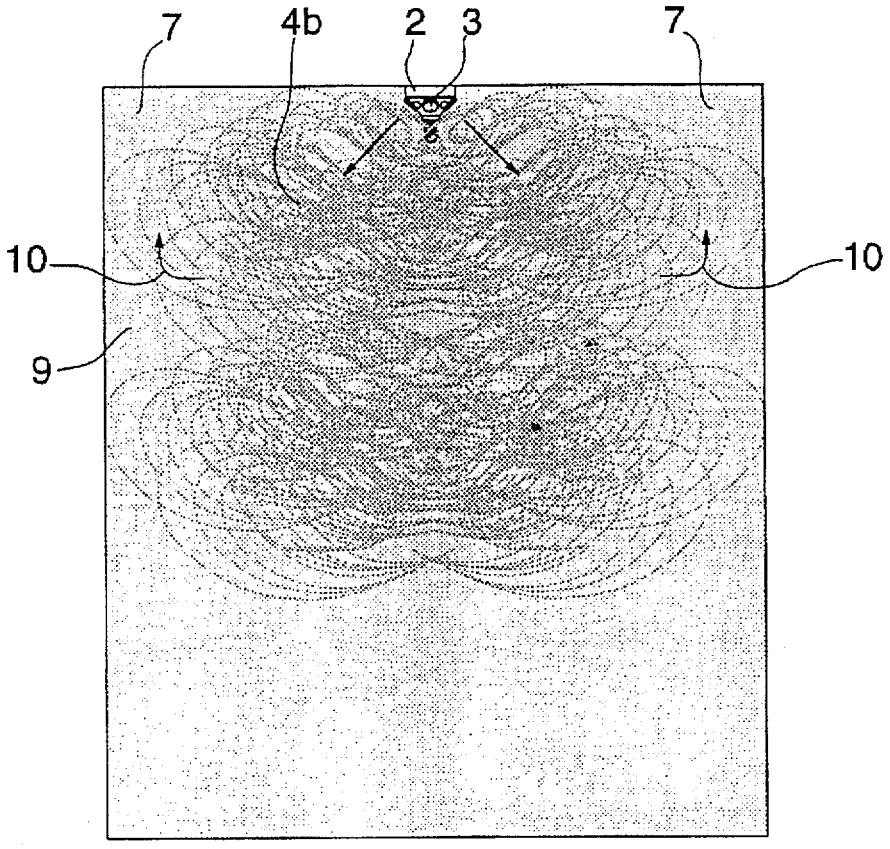

In FIGS. 1, 2 and 3, a room is indicated by the reference numeral 1. In the ceiling of the room 1 is mounted a spray head or sprinkler 2 with e.g. four nozzles 3 directed obliquely outwards and downwards.

When water only is sprayed at a drive pressure e.g. from about 200 bar to about 120 bar, a concentrated fog-like liquid spray 4 is obtained which is capable of striking through rising smoke gases down to the floor of the room to extinguish, or at least suppress even a violent fire at the floor level.

A concentrated fog-like liquid spray 4 is obtained by means of a certain combination of the mutual distance between the nozzles of the spray head or sprinkler 2, of the direction of the nozzles 3, of the outlets of the nozzles 3 which determine the droplet size, and of the drive pressure of the liquid. At the right combination of these factors, which combination, due to the absence of a reliable theory and formula, can be determined by experiments, there is produced a suction which keeps the fog-like liquid spray together, as illustrated by arrows 5 and 6 in FIG. 1. It is hereby essential that air can be sucked in to the spray head 2 along the ceiling of the room, behind the nozzles 3 of the spray head, which means that the nozzles 3 should not be too close to the ceiling; a distance of about five centimeters is usually sufficient. Together with the air, arrows 5 and 6, smoke gases and carbon monoxide are sucked in to participate in fighting the fire when they follow along with the fog-like liquid spray 4.

In the situation illustrated in FIG. 1, there is thus a rather strong circulation of liquid fog and smoke gases from the floor of the room up to the ceiling and down again, but the effect near the ceiling, especially in the corner areas 7 where the walls and the ceiling meet, is somewhat limited; smaller fires, e.g. cable fires, have a tendency to remain smouldering.

According to the invention it is therefore suggested that the concentrated fog-like liquid spray 4 is scattered after a predetermined time, by breaking the aforementioned combination necessary in order to obtain the concentrated spray 4, by mixing a high pressure gas, preferably nitrogen drive gas from one or a plurality of high pressure hydraulic accumulators forming a drive unit for the spray head 2, into the liquid. Due to the thereby decreased droplet size, in combination with an at least momentarily increased velocity out of the nozzles 3, the suction indicated by the arrows 5 and 6 is weakened so much, that the spray is no longer held together and instead is obtained a more spread liquid fog configuration, as indicated by the arrows 8 in FIG. 2. The high flow velocity and the reflection from the walls of the room result in a strong turbulence, indicated by **4*a* in FIG. 2, as well as a finely distributed liquid fog, shown in grey colour and indicated by 9 in FIG. 2**.

As long as the amount of gas fed into the extinguishing liquid is comparatively small, as in FIG. 2, the finely distributed liquid fog 9, which is effective in finally extinguishing rather small fires in general, and smouldering fires in particular, has certain difficulties in reaching into the corner areas up in the room.

This problem is solved by, in a third step, feeding a larger amount of gas into the extinguishing liquid, said third step being illustrated in FIG. 3. When hydraulic accumulators are used as drive unit for the spray head or sprinkler 2, the third step can be commenced when the drive pressured has decreased to about 70 bar. The fog-like liquid sprays are now spread out further, the turbulence **4*b* is weakened more, and the finely distributed liquid fog 9 can fill even the corner areas 7 up in the room, especially when using a mixing gas lighter than air, such as e.g. nitrogen gas. The nitrogen gas then gradually accumulates at the ceiling, as indicated by arrows 10 in FIG. 3**, and brings along small droplets. Nitrogen gas alone has a smothering effect which is improved by the water droplets which have a cooling effect also.

Figure 4:
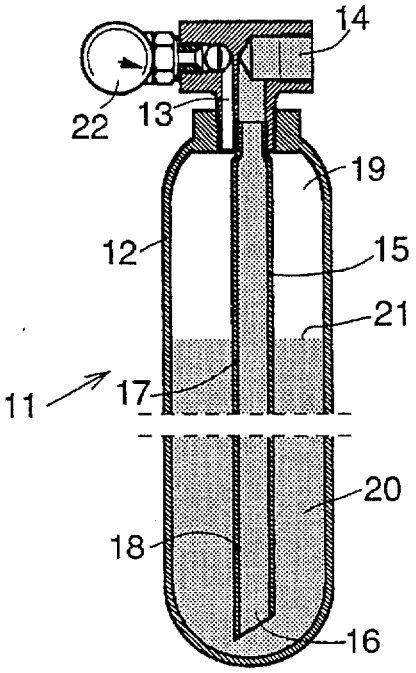
Figure 5:
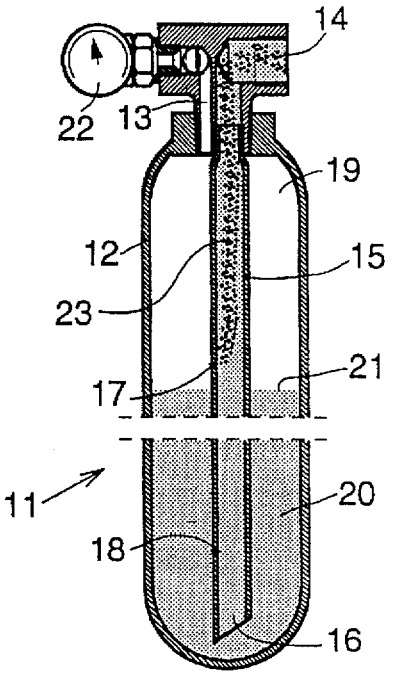
Figure 6:
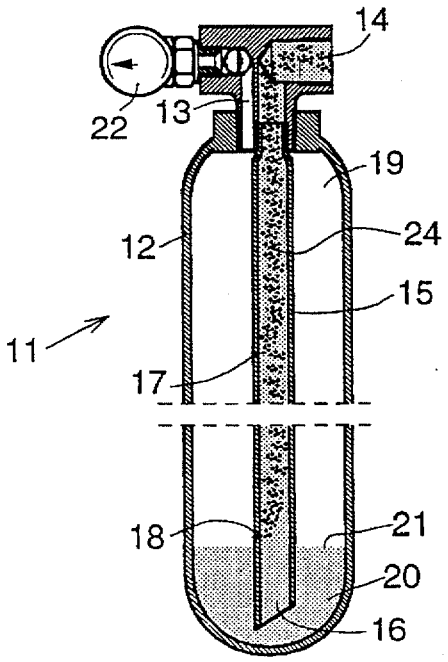

In FIGS. 4–6 a hydraulic accmulator is generally indicated by he reference numeral 11. The hydraulic accumulator comprises a pressure container 12 with an inlet 13 for compressed gas, e.g. nitrogen gas, and an outlet 14 for connection to an outgoing line or hose.

In the container 12 is arranged a tube 15 with an inlet 16 near the bottom of the container and with the opposite end connected to the outlet 14. The pipe 15 has two apertures 17 and 18 in its wall, at different levels in such a manner that the aperture 17 is relatively far from the tube inlet 16 whereas the aperture 18 is considerably closer to the tube inlet 16. The reference numeral 19 indicates a gas space, 20 indicates water, 21 indicates the water surface, or water level, and 22 indicates a manometer.

In the state of readiness, the container 12 is to a great extent filled with liquid, preferably water, i.e. the gas space is small and the gas pressure is high. An outlet valve provided in the outgoing line, not shown, is closed.

When the extinguisher is activated, the high pressure drive gas starts driving the water out through the pipe 15 to the outlet 14 and further to at least one spray head or sprinkler to produce a fog-like liquid spray having a droplet size of typically 50 to 150 microns and capable of penetrating hot smoke gases generated by the fire, in order to at least suppress the fire.

The water level gradually sinks in the container 12 whereas the gas space 19 becomes larger, correspondingly, and the gas pressure falls. In FIG. 4 the water level 11 has not yet reached the aperture 17 in the wall of the tube 5 and the hydraulic accumulator delivers water only. If the initial charge pressure of the hydraulic accumulator is about 200 bar, the aperture 17 can preferably be positioned so that the gas pressure of the accumulator has decreased to e.g. about 120 bar when the the water level reaches the aperture 17.

In FIG. 5 the water level has passed the wall aperture 17 of the tube 15 and gas flows through the aperture 17 into the water flow, as indicated in FIG. 5 by gas bubbles 23. Due to the intermixed gas, the size of the droplets in the fog-like liquid spray is reduced, and the spray loses its penetration power to such an extent that it takes the form of a turbulent water/gas-fog, which fills the fire room in a considerably more even manner as what the initially sprayed more concentrated fog spray did.

In FIG. 6 the water level has passed the second wall aperture 18 also, and more drive gas flows into the tube 15, as indicated by bubbles 24 in FIG. 6. It is of course possible to provide apertures in the tube wall at more than two levels and to provide a plurality of apertures at each level. In general the desired effect is accomplished by a few small apertures having a diameter of e.g. 1 to 2 mm. The aperture 18 can be positioned such that the gas pressure of the hydraulic accumulator has decreased to about 70 bar when the water level reaches the aperture 18.

As the amount of gas mixed into the liquid increases in proportion to the amount of liquid, the droplet size will decrease further, as well as the turbulence of the liquid fog, which latter still remains sufficiently strong to fill the whole fire room essentially evenly with the liquid fog, especially if nitrogen gas is used as drive gas for the hydraulic accumulator. Since nitrogen gas is a little lighter than air, it will gradually rise towards the ceiling and thereby bring along liquid droplets.

By mixing drive gas in this manner into the flow of extinguishing liquid it is possible to maintain an effective liquid spray until the container 12 is practically completely empty, whereat the pressure of the drive gas has fallen considerably. The pressure fall of the drive gas is in FIGS. 4–6 illustrated by the different positions of the indicator of the manometer 22.

Figure 7:
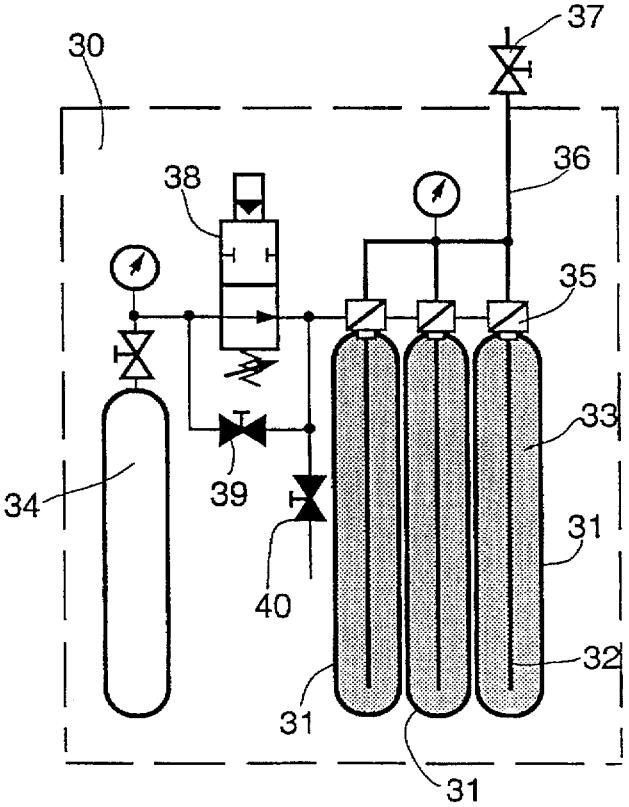
FIGS. 7, 8 and 9 show three embodiments of drive units having a relatively large capacity.
Figure 8:
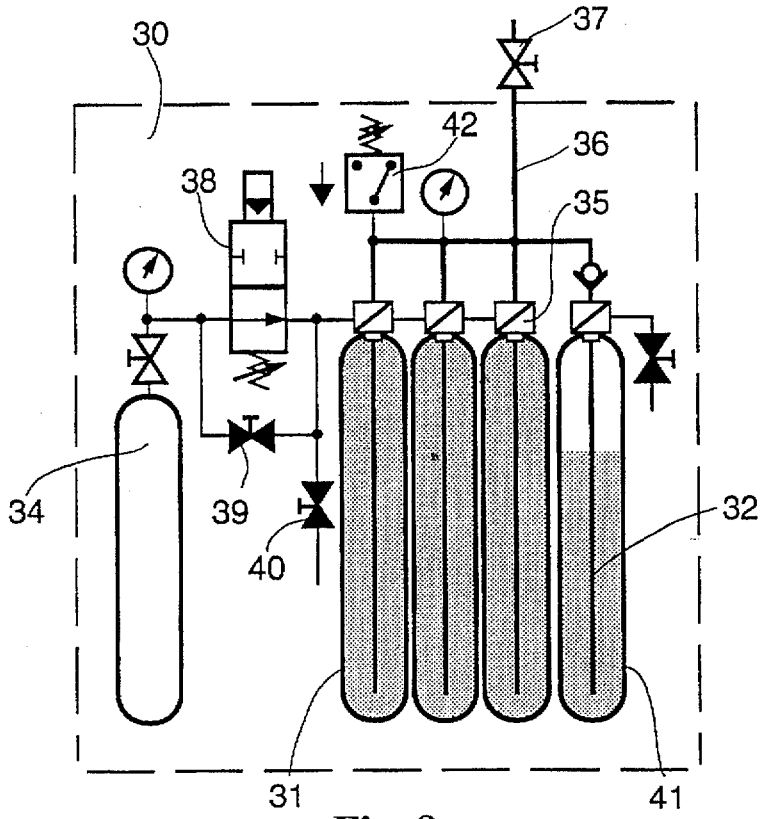
Figure 9:
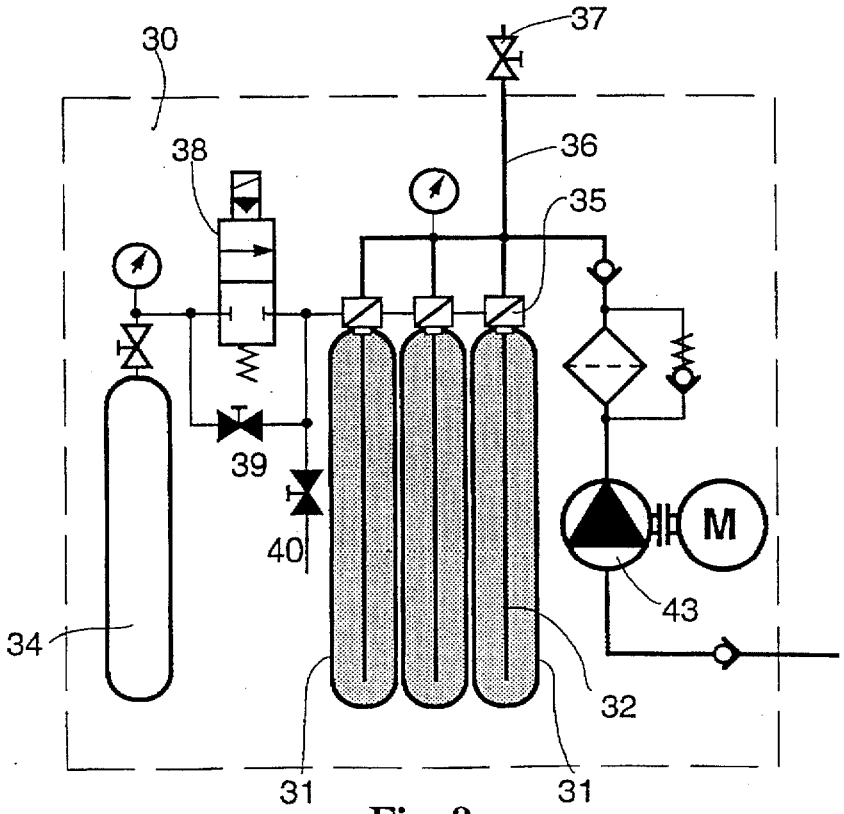

In the embodiments of FIGS. 7, 8 and 9, the drive unit of the fire-fighting equipment is generally indicated by 30. Three hydraulic accumlators are indicated by 31 and correspond to the accumlator 11 in FIGS. 4–6, each accumulator 31 thus comprising an inner tube 32 like the tube 15 in FIGS. 4–6, wall apertures included. The drive units 30 are in FIGS. 7–9 in a state of readiness, i.e. the accumulators 31 are filled with liquid, numeral 33 in FIG. 7.

A common source of drive gas for the hydraulic accumlators 31, in FIGS. 7–9 a pressure container with nitrogen gas and a charge pressure of about 200 bar, is indicated by 34. Connection means for gas into the accumulators and for liquid and a mixture of liquid and gas, respectively, out of the accumulators are indicated by 35, a common outlet line for the accumlators is indicated by 36 and a pilot valve therein is indicated by 37. An automatic, e.g. electrically operated pilot valve for connecting the gas container 34 is indicated by 38, a manually operable valve for the same purpose is indicated by 39 and a valve for filling and possibly emptying the accumulators is indicated by 40.

The drive unit of FIG. 7 works in the same way as has been described in the foregoing with reference to FIGS. 4–6.

The drive unit of FIG. 8 comprises an additional hydraulic accumlator indicated by 41 and in parallel with the accumulators 31, and like these having an inner tube 32 with wall apertures. The accumulator 41 has preferably nitrogen gas as drive gas, like the accumulators 31, but the charge pressure is relatively low, e.g. about 25 bar. This additional accumulator 41 is used for spraying liquid and a mixture of liquid and gas, respectively, through activated spray heads in the beginning of the extinguishing process, in order to cool these spray heads and secure that the lines to the spray heads are filled with liquid before commencing high pressure liquid spraying.

In the drive unit of FIG. 9, a liquid pump 43 takes care of cooling the spray heads and filling the lines to them before spraying high pressure liquid. The pump 43 can further be used for refilling the hydraulic accumulators when emptied, preferably with a simultaneous cooling spray to the fire seat.

In the embodiments of FIGS. 7 to 9 it is possible to, instead of a separate gas container 34 in common for the accumulators 31, have the accumulators 31 made as the accumulator 11 in FIGS. 4 to 6.

Figure 10:
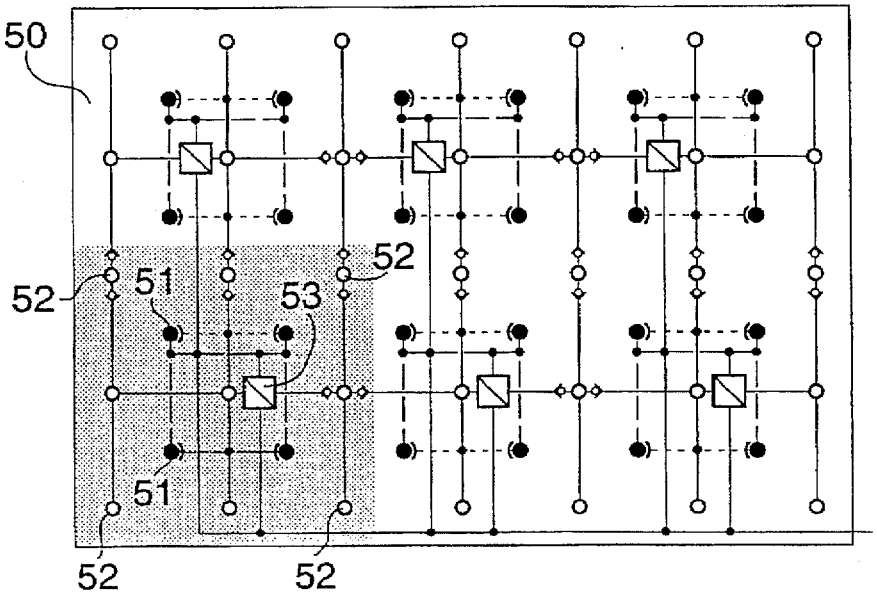
FIG. 10 shows an application of the invention, for a larger space, such as a restaurant room.

FIG. 10 shows an application of the invention for a larger space, such as a restaurant room, which in FIG. 10 is viewed from above and is indicated by 50. the room is monitored by a number of groups of spray heads, the action area of one such group is in FIG. 10 shown in grey colour. A group comprises a number of activating, or primary spray heads or sprinklers 51 and a preferably somewhat greater number of secondary spray heads 52. When a primary spray head 51 is activated as a result of a fire withing its action area, all spray heads of that particular group are activated by means of a governor valve 53, e.g. in the way as presented in the international patent application PCT/FI92/00316. Those spray heads which are positioned along the periphery of the action area of the group bar the action area off from the rest of the restaurant room by producing curtains of liquid fog. Within the thus restricted area the function is essentially the same as described in the foregoing.

I claim:

1. An installation for fighting fire, comprising:

a spray head for spraying a liquid; and at least one hydraulic accumulator (11) with an outlet (14) to the spray head for supplying the liquid thereto, the hydraulic accumulator comprising a gas space (19), for a gas at pressures, a liquid space (20) for the liquid, the liquid space having one end portion in communication with the gas space and an opposite end portion, and a tube (15) having an end in the opposite end portion of the liquid space and extending to the outlet, the tube further having at least one aperture (17, 18) thereinto from the liquid space at a predetermined distance from the end of the tube, whereby the pressures of the gas drive the liquid from the end of the tube to the outlet and the gas into the tube (15) through the aperture (17, 18) when the level (21) of the liquid in the liquid space is below the aperture relative to the one end portion of the liquid space in order to intermix the gas with the liquid and, thus, produce a scattered spray (4*a*, 4*b*), wherein the spray head has nozzle means for making the spray fog-like and concentrated with good penetration power when the pressures are in effectively high amount and produces the scattered spray in the form of a turbulent fog at lower pressures.

2. The installation as claimed in claim 1, wherein the tube (15) has another of the aperture (17, 18) therealong, whereby the amount of the gas intermixed with the liquid increases as the pressures decrease.

3. The installation as claimed in claim 1, wherein the gas is nitrogen gas with an initial pressure of about 200 bar.

4. The installation as claimed in claim 1, wherein:

the liquid space comprises a plurality of hydraulic accumulators (31) coupled in parallel; and the gas space comprises a source (34) to deliver the gas to the hydraulic accumulators in common.

* * * * *